US006318155B1

(12) United States Patent
Carr

(10) Patent No.: US 6,318,155 B1
(45) Date of Patent: Nov. 20, 2001

(54) PRESSURE TESTING APPARATUS

(76) Inventor: Bruce Carr, 21 Spinnaker Crescent, Ballina, New South Wales, 2478 (AU)

( * ) Notice: Subject to any disclaimer, the term of this patent is extended or adjusted under 35 U.S.C. 154(b) by 0 days.

(21) Appl. No.: 09/463,604

(22) PCT Filed: Jul. 27, 1998

(86) PCT No.: PCT/AU98/00586

§ 371 Date: Jan. 25, 2000

§ 102(e) Date: Jan. 25, 2000

(87) PCT Pub. No.: WO99/05497

PCT Pub. Date: Feb. 4, 1999

(30) Foreign Application Priority Data

Jul. 25, 1997 (AU) ..... PO8269
Dec. 17, 1997 (AU) ..... PP0963

(51) Int. Cl.[7] ..... G01M 3/32
(52) U.S. Cl. ..... 73/49.7
(58) Field of Search ..... 73/40, 40.5 R, 73/46, 47, 49.7, 49.8

(56) References Cited

U.S. PATENT DOCUMENTS

| | | | | |
|---|---|---|---|---|
| 3,623,372 | * | 11/1971 | Markey | 73/49.7 |
| 3,650,147 | * | 3/1972 | Moyer | 73/49.7 |
| 3,750,711 | * | 8/1973 | Conklin et al. | 138/97 |
| 4,235,100 | | 11/1980 | Branchini . | |
| 4,417,465 | | 11/1983 | Noe et al. . | |
| 4,458,523 | * | 7/1984 | Moyer | 73/49.7 |
| 4,494,402 | | 1/1985 | Carney . | |
| 4,667,507 | * | 5/1987 | Eriksson | 73/49.7 |
| 4,953,396 | | 9/1990 | Langsdorf et al. . | |
| 5,152,167 | * | 10/1992 | Moody | 73/40 |
| 5,193,381 | | 3/1993 | Heimann . | |
| 5,425,266 | * | 6/1995 | Fournier | 73/49.7 |
| 5,460,030 | * | 10/1995 | Bloxsom et al. | 73/19.05 |
| 5,557,966 | | 9/1996 | Corry . | |
| 5,705,737 | * | 1/1998 | Liao | 73/49.7 |
| 5,760,296 | * | 6/1998 | Wilson | 73/49.7 |
| 5,835,976 | * | 11/1998 | Kent et al. | 73/40.7 |
| 5,898,105 | * | 4/1999 | Owens | 73/49.8 |
| 6,082,182 | * | 7/2000 | Fierro et al. | 73/40.5 R |

OTHER PUBLICATIONS

The American Heritage® Dictionary of the English Language, Third Edition copyright® 1992 by Houghton Mifflin Company. Electronic version licensed from INSO Corporation; further reproduction and distribution restricted in accordance with the copyright Law.*

* cited by examiner

*Primary Examiner*—Hezron Williams
*Assistant Examiner*—Charles D. Garber
(74) *Attorney, Agent, or Firm*—Stroock & Stroock & Lavan LLP

(57) ABSTRACT

A pressure testing apparatus for a cooling system of an internal combustion engine said pressure testing apparatus comprising a first air conduit (11), means (11A, 117A) for regulating air pressure associated with the first conduit (11) and an exhaust conduit (70, 120) in fluid communication with the first air conduit (11) for exhausting of coolant from the cooling system after use and selectively actuatable valve means (61, 116) controlling the flow of coolant from the first air conduit (11) into the exhaust conduit (70, 120), whereby, in use, pressurized air can be supplied to the cooling system to pressurize the cooling system to facilitate the detection of any fluid leaks present.

7 Claims, 10 Drawing Sheets

FIG. 3A
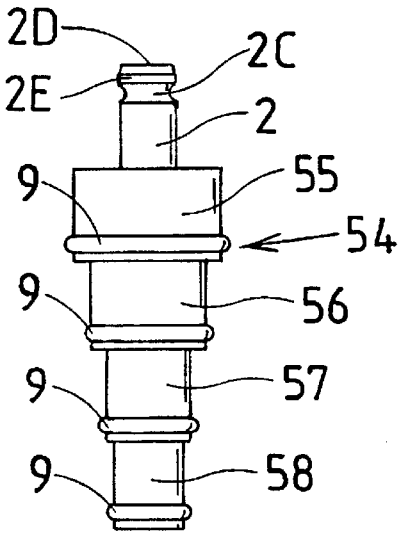
FIG. 3B
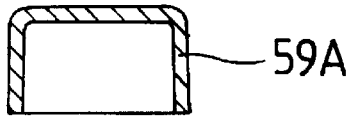
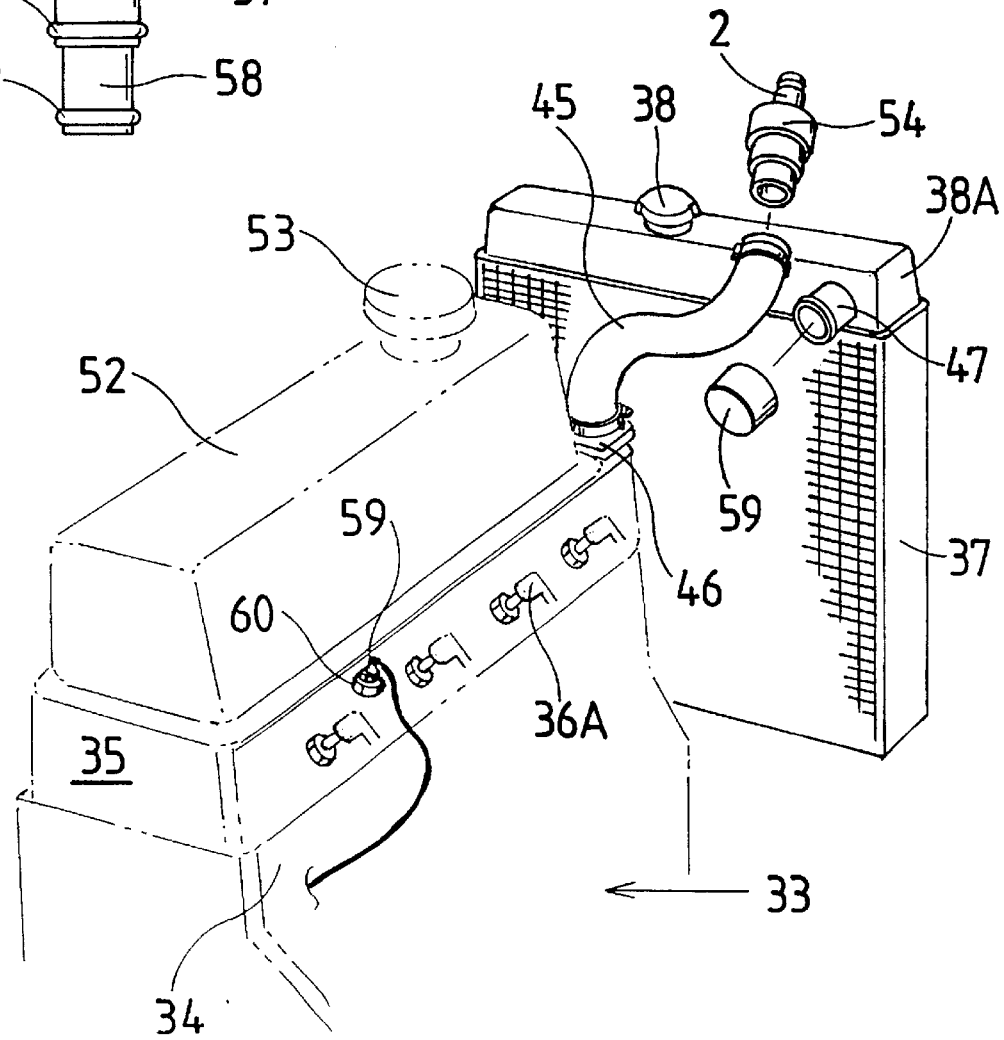
FIG. 3

PRESSURE TESTING APPARATUS

FIELD OF THE INVENTION

THIS INVENTION relates to a pressure testing apparatus for testing the integrity of fluid cooling systems of internal combustion engines, such as in motor vehicles, trucks, tractors and machinery.

BACKGROUND OF THE INVENTION

It is common for internal combustion engines to be associated with a cooling system, to dissipate heat from the engine in order to prevent engine damage through overheating. Such cooling systems usually employ fluid coolants due to their thermal conductivity, and their ability to circulate throughout the cooling system.

A typical basic cooling system, such as for the engine of a motor vehicle, comprises a fluid coolant such as water, and in some cases additives which modify the freezing and boiling point of the coolant, a coolant reservoir such as a radiator or header tank with a removable cap and overflow outlet, a pump to assist circulation of the coolant, and a series of fluid conduits for circulation of fluid from radiator to an engine block, from the engine block to a heater, from the heater back to the engine block, and from the engine block back to the radiator. The coolant fluid removes heat from the engine, and is then cooled by being passed through the radiator, which comprises a relatively large surface area exposed to cool air such as supplied by a fan, or by air forced past the radiator through movement of the vehicle. However, if leaks in the cooling system are present, such leaks would lead to substantial loss of cooling fluid and will also make the cooling system work inefficiently, with the result that the engine can overheat. Although devices such as a temperature gauge can indicate overheating before damage occurs to the engine, detecting the source of the leak with a view to repair is often difficult, time consuming and expensive. Diagnosis of leaks is often complicated by the fact that the rate of fluid loss can be very slow, and therefore difficult to detect by observation.

Several types of pressure testing apparatus are available that aid in the detection of cooling system leaks. A standard conventional type comprises a cap-like fixture associated with a hand pump having a non-return valve and a pressure gauge in fluid communication with the hand pump, the cap-like fixture being attachable to an inlet of a radiator, after the radiator cap has been removed. The cap-like fixture did not incorporate any pressure relief valve as is common with conventional radiator caps. In this conventional pressure testing apparatus, the hand pump was used to increase the pressure of the cooling system to a desired level as indicated by the pressure gauge, after which a fall in pressure was indicative of a leak somewhere in the cooling system or the non-return valve of the hand pump. In a variation of this arrangement, an inflatable bladder was used in substitution of the cap-like fixture which is described in U.S. Pat. No. 5,557,966.

In relation to the aforementioned prior art, a number of disadvantages are applicable which are set out hereunder:

(a) the engine must be turned off to avoid loss of coolant when the radiator cap is removed with the result that the cooling system is not tested under normal operating temperature conditions;

(b) the integrity of the radiator cap and its seal with the radiator inlet cannot be tested simultaneously with operation of the pressure testing apparatus;

(c) the pressure testing apparatus is labour intensive, requiring frequent hand pumping to repeatedly pressurize the cooling system should it be difficult to find a leak; and (d) accidental over-pressurization can damage components of the cooling system and the engine, as the radiator cap, which is removed during operation of the device, provides the only means of relieving pressure in the cooling system.

Reference may also be made to U.S. Pat. No. 4,449,402 which refers to a pressure testing apparatus which comprises a conduit, a source of pressure for the conduit, a pressure gauge for determining the level of pressure within the conduit, a check valve interposed between the pressure source and the conduit, and means for connection of the conduit to a vent of a filler neck of a radiator which filler neck is engageable with a radiator cap. The filler neck has an open mouth surrounded by an outer seat and there is also provided an inner seat as well as an overflow vent and an interior chamber between the inner and outer seats. The radiator cap engages with the inner seat of the filler neck to form outer and inner seals. The radiator cap also includes a vacuum valve operative as a bypass of pressure from the interior chamber of the filler neck through the radiator cap into the engine cooling system. The pressure testing apparatus of U.S. Pat. No. 4,449,402 therefore allows the integrity of the radiator and cap seals and the cooling system to be tested simultaneously while retaining the relief valve function of the radiator cap.

However, the pressure testing apparatus of U.S. Pat. No. 4,449,402 was subject to the aforementioned disadvantages (a), (c) and (d).

However, while disadvantage (b) was not directly applicable, it was the case that the pressure testing apparatus of U.S. Pat. No. 4,449,402 could not efficiently detect any leaks in the radiator cap in an efficient manner because of a multiple step procedure being required for initial pressurization of the cooling system to attain the appropriate maximum pressure rating followed by decrease of pressure to ambient pressure by control of the check valve. If there is no increase in pressure which would indicate a failure of the inner seal, then it was necessary to remove the cap from the filler neck for separate testing of both seals.

It will also be apparent that disadvantage (d) was clearly applicable in that the pressure testing apparatus of U.S. Pat. No. 4,449,402 can also only test for leaks in the radiator cap when the valve stem in the vacuum relief valve is in the open position. This also means that when the pressure testing apparatus is operational, the vacuum relief valve is inoperative and thus there is no inbuilt pressure relief valve to detect over-pressurization of the cooling system which can cause rupture or damage to the cooling system.

It was also necessary to appreciate that the pressure testing apparatus of U.S. Pat. No. 4,449,402 has a very limited application in that it can only be applied to a radiator cap having inner and outer seals as described above. Therefore, it can only be applied to a limited number of internal combustion cooling systems.

Reference may also be made to U.S. Pat. No. 5,105,653 which refers to pressure testing apparatus, a valve assembly housing which includes a valve inlet connectable to a source of compressed air, a metering orifice adjacent to the inlet in fluid communication with internal passages of the housing for transmission of compressed air, a check valve which maintains compressed air in the internal passages of the housing and which also may communicate with low pressure passages in the housing which lead to an air pressure gauge, a pressure relief valve communicating with the low pressure passages, a low pressure outlet passage connectable to a flexible hose which is attached to a radiator test adaptor which connects the hose to the filler neck of a standard radiator to discharge low pressure air into the cooling system of a vehicle as well as a secondary pressure relief valve holding a seal at the mouth of the filler neck.

However, it is clear in relation to the pressure testing apparatus of U.S. Pat. No. 5,105,653 that the abovementioned disadvantages (a) and (b) referred to above is applicable. However, it was also relevant to note that this pressure testing apparatus was unduly complicated in structure which necessitates provision of relevant tooling for manufacture of the valve assembly housing. Two pressure relief valves are required. The adaptor is of specialized structure and adapted to replace the standard radiator cap in use. The pressure testing apparatus is only attachable at the radiator filler neck and thus is of limited application.

Another method of pressurizing the cooling system is described in U.S. Pat. No. 4,458,523, wherein water is introduced into the fluid conduit connecting the heater and engine block to achieve a desired pressure and so allow visual and auditory detection of fluid leaks in the cooling system, and the integrity of the seal between radiator inlet and cap.

Australian Patent Application 27245/95 also discloses a pressure testing apparatus that introduces water heated to a temperature similar to that achieved under engine running conditions directly into the engine block. Thus, leaks which appear during normal operation, but disappear due to contraction upon cooling, would be more likely to be detected because normal operating temperatures have been achieved.

However, the use of introducing water into the coolant circuit requires ancillary apparatus not required for systems using pressurized or compressed air and is labour intensive.

Reference may also be made to a conventional pressure testing apparatus marketed under the trade mark "FLO-KLEEN" which is available from Flo-Kleen Products of Balcatta, Western Australia. In one arrangement, the pressure testing apparatus included an air conduit which was attachable to a bleed hose or overflow hose of a radiator by an adaptor incorporating a manually operable lock-on handle. The air conduit was attachable to a hand pump incorporating a pressure dial for measuring the pressure when required. However, this pressure testing apparatus did not include a regulator and hence could not be connected to an air compressor. There was also no means for exhausting or venting coolant from the cooling system being tested from the FLO-KLEEN apparatus after use. Again, this mitigated against connection of the FLO-KLEEN apparatus to a compressor.

In an alternative arrangement, the FLO-KLEEN pressure testing apparatus included an air conduit which could permanently replace the coolant drain plug in the side of the engine block. This alternative arrangement also included a trigger operated device attached to the air conduit wherein the trigger operated device also included a pressure dial for measurement of the pressure in use. This arrangement could be connected to an air compressor and associated regulator and, to this end, there was also provided a pressure release mechanism which was a spring operated button or projection which, when pressed inwardly against the bias of the spring, could also release excess fluid in the cooling system and pressure testing apparatus to atmosphere. However, this pressure testing apparatus did not include any means for switching off the flow of pressurized air from the compressor and thus the compressor could not be utilized for other purposes if desired.

Another disadvantage of this alternative arrangement was that the compressor could not be disconnected from the cooling system in use.

OBJECT OF THE INVENTION

It is therefore an object of the invention to provide a device for testing the integrity of internal combustion cooling systems which alleviates at least some of the disadvantages associated with the prior art.

It is a further object of the invention to provide a method of detecting cooling system leaks.

SUMMARY OF THE INVENTION

The present invention, therefore, resides in an internal combustion engine cooling system pressure testing apparatus connectable to a source of pressurized air, said pressure testing apparatus comprising as separate components:

a first air conduit;

means for regulating air pressure associated with said first air conduit to maintain air pressure at a predetermined value; and means for switching off the flow of pressurized air from the source, whereby, in use, pressurized air can be supplied to the cooling system via the first air conduit to initially pressurize the cooling system and subsequent detection of any fluid leaks present takes place when said flow of pressurized air is switched off and said air pressure maintained at said predetermined value.

It will be appreciated that by provision of the regulating means and switching means as separate components that the pressure testing apparatus may be disconnected from the source of pressurized air, such as a compressor, so that the compressor may be used for other purposes when the cooling system is pressurized. Also, the pressure testing apparatus may be "self-tested" when required to ensure that no leaks are present. Also, if the switching means is located downstream of the regulator, then this will prevent coolant from the cooling system from contaminating the regulating means.

There may also be provided an adaptor which is connectable to the first air conduit and which, in some cases, may be connectable to a fluid port of the cooling system but which, more preferably, is connectable to an existing conduit of the cooling system. In this latter arrangement, the adaptor may also be connectable to a second air conduit which, in use, is attached to a fluid port of the cooling system from which the existing conduit has been disconnected.

The first and second conduits may suitably be formed from flexible hoses although rigid pipes or tubes may be used if necessary in particular situations.

The adaptor may be of any suitable configuration which has retaining projections or sockets so as to retain the first air conduit and the existing conduit. In the case where the adaptor is attached to a second air conduit, the adaptor may suitably be T-shaped or Y-shaped or any other shape that comprises three or more outwardly projecting projections or mounting sockets which may engage with the abovementioned conduits.

Suitably, the source of pressurized air will be a compressor driven by an electric, petrol, diesel or other motor, such as found in many workshops and garages or compressed air cylinder fitted with a regulator. Alternatively, a hand pump or garage pump may be utilized which delivers pressurized air although it is preferred to use a compressed air source.

The control valve may include a movable valve member attached to an operating handle which can move the valve member in an appropriate valve housing from an inoperative to operative position or vice versa. Suitably, the control valve may be a gate valve or spool valve. Alternatively, the control valve may be a non-return valve such as a check valve if desired.

Suitably, the means for regulating air pressure will comprise an adjustment device which may include a diaphragm or other form of reducing valve or governor so as to regulate or maintain pressure in the cooling system at a value as per manufacturer's specifications which is usually less than the maximum pressure rating for a specific cooling system or internal combustion engine.

There also may be utilized a pressure gauge or other form of pressure indicator or pressure measuring device, e.g. an analog gauge or digital LED or LCD display.

The selectively actuatable valve means for controlling flow of coolant from the first air conduit may include a manually operated valve or an automatically operated valve as may be required. Preferably the selectively actuatable valve means is operable so as to move an internal valve member from an inoperative to operative position or vice versa as may be required. A spool valve or gate valve may also be used or a spring operated valve member as may be required.

Preferably the selectively actuatable spring means interconnects the first air conduit and the exhaust conduit and thus facilitates safe discharge of hot or toxic coolant into a suitable receptacle so as to prevent the coolant from discharging to atmosphere.

The invention also provides a method of pressure testing a cooling system of an internal combustion engine including the steps of:

(i) placing the cooling system in fluid communication with a source of pressurized air;

(ii) passing pressurized air into the cooling system;

(iii) adjusting the pressure developed within the cooling system to a predetermined value which may accord with manufacturers' specifications which is usually less than a maximum pressure rating of the cooling system;

(iv) if desired, switching off the source of pressurized air;

(v) checking for pressure leaks within said cooling system; and (vi) allowing for exhausting of coolant from the cooling system by directing the flow of coolant into a receptacle from an exhaust conduit.

In step (i), the cooling system may have a fluid port which engages with the aforementioned first air conduit. However, more preferably, an existing conduit is disconnected from an associated fluid port of the cooling system and is placed in fluid communication with the source of pressurized air, as described hereinafter.

Preferably in step (i), the existing conduit has a free end which is attached to the aforementioned adaptor which is connected to the first air conduit which is in fluid communication with the source of pressurized air. In this embodiment, the second air conduit may also be attached to the adaptor and also to the port whereby the existing conduit is in fluid communication with the port.

Once the cooling system is pressurized, leaks can be detected in two different ways. Firstly, this can be accomplished by disconnection of the source of pressurized air and by checking for a decrease in cooling system pressure. Second, leaks can be detected by visual or auditory inspection of cooling system components, with the source of pressurized air connected to maintain constant pressure. This second method is particularly applicable when detecting slow leaks, wherein the operator can leave the cooling system pressurized for extended periods in order to produce observable quantities of leaked fluid.

The pressurization of the cooling system can suitably be performed with the engine operating and the radiator cap in place, to provide normal operating temperature, and retain the pressure relief valve function of the radiator cap. Preferably, the engine would be switched off prior to connection of the pressure testing apparatus to the cooling system, so that the operator can avoid hot fluid released from the cooling system upon disconnection of the fluid conduit from the cooling system port. The engine can then be operated once the pressure testing apparatus of the invention has been connected to resume normal operation. Suitable air pressure would be determined according to manufacturer's specifications or other technical literature.

BRIEF DESCRIPTION OF THE DRAWINGS

Reference may now be made to a preferred embodiment of the present invention in which:

FIG. 3 is a perspective view of an embodiment of pressure testing apparatus in accordance with the invention different to that shown in FIGS. 1–2;

FIG. 3A is a side view of an adaptor for use in the embodiment of FIG. 3;

FIG. 3B is a side view of a port seal for use with the embodiment of FIG. 3;

DETAILED DESCRIPTION OF THE PREFERRED EMBODIMENT

Figure 1:
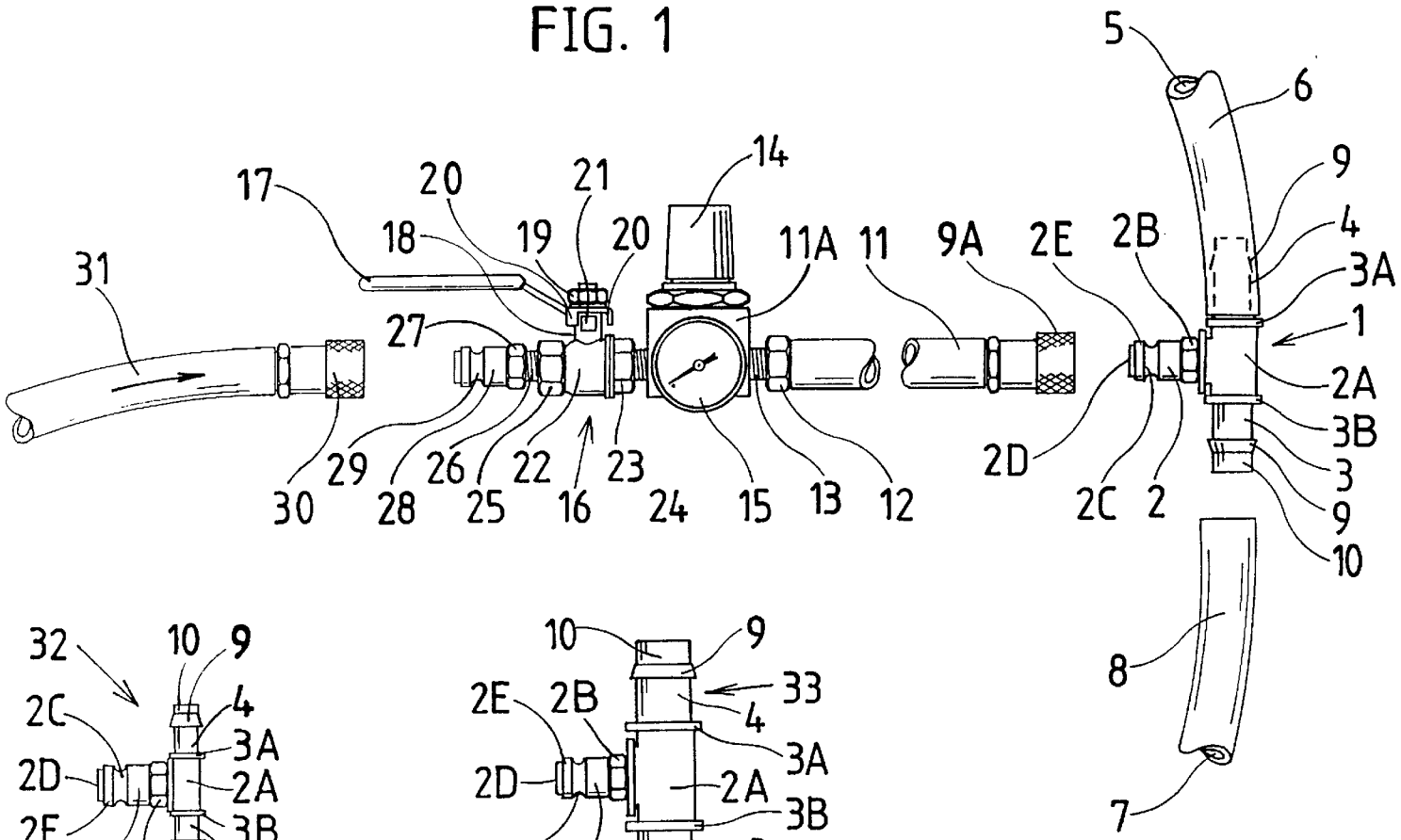
FIG. 1 is an exploded view of pressure testing apparatus in accordance with one embodiment of the invention.

The pressure testing apparatus of the invention includes a substantially hollow T-shaped adaptor 1, comprising first arm 2, second arm 3, and third arm 4. Arm 2 is attached to central part 2A of adaptor 1 by nut 2B. Central part 2A is defined by flanges 3A and 3B. Arm 2 comprises a peripheral groove 2C to facilitate attachment of female member 9A described hereinafter. Arm 2 also includes end 2D of reduced diameter and abutment flange 2E. The second and third arms 3,4 of adaptor 1 preferably have equal external dimensions, so that either arm is capable of being inserted into either bore 5 of second air conduit 6 or bore 7 of existing fluid conduit 8, after removal of one end of existing fluid conduit 8 from a port of a component of a cooling system shown in FIG. 2. Second air conduit 6 is connectable to the cooling system port after removal of one end of conduit 8.

In the example in FIG. 1, arm 3 is shown connected to existing conduit 8, and arm 4 is connected to second air conduit 6. Retaining flange 9 of arm 3 assists in maintaining the connection between arm 3 and existing conduit 8; arm 4 includes a similarly functioning retaining flange 9. Arms 3 and 4 also includes an outer end 10 which may be of reduced diameter to facilitate connection of arms 2 and 3 to conduits 6 and 8.

First arm 2 is retained by a female connector 9A located at one end of first air conduit 11 which is associated with a selectively actuatable valve 61 shown hereinafter in FIG. 5. Such valve has been deleted from FIGS. 1–4 for the sake of convenience. The other end of first air conduit 11 is attached to pressure regulator 11A by nut 12 attached to screw threaded part 13 of regulator 11A. The pressure regulator 11A includes an adjustment knob 14 for adjusting pressure and a gauge 15 for measurement of air pressure. There is also shown a control valve 16 for controlling flow of pressurized air through first air conduit 11. The control valve 16 includes actuating arm 17 which is attached to projection 18 of valve 14 by fastener 19. The actuating arm 17 also includes tabs 20 for engaging with stops 21 when moving from an inoperative position to an operative position or vice versa.

The control valve 16 also includes valve housing 22 and includes attachment nut 23 for attachment to screw-threaded stud 24 of regulator 11A. The control valve 16 also includes nut 25 for attachment to screw-threaded stud 26 to which is attached nut 27 of connector 28 having a groove 29 for engagement with female member 30 of hose 31 to which is attached to a source of compressed air as is indicated by the arrow in full outline.

Figure 1B:
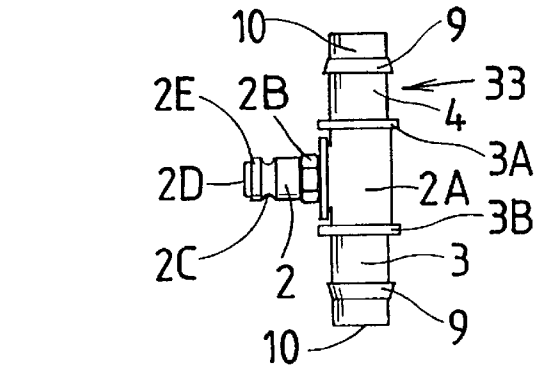
FIGS. 1A and 1B are views of the adaptor utilized in the pressure testing apparatus of FIG. 1 having different dimensions for attachment to different cooling systems.
Figure 1A:
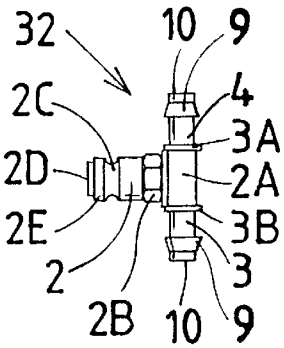

As shown in FIGS. 1A and 1B, adaptors 32 and 33 can be manipulated with a range of relevant external dimensions. Accordingly, a plurality of second air conduits 6 can be constructed, each with a different diameter bore 5. Such a plurality of adaptors 1 and second air conduits 6 as described above, could be provided in kit form, to suit different kinds of cooling systems. Thus for any particular application, an operator would use a second air conduit 6 where the diameter of internal bore 5 is substantially equal to the diameter of internal bore 7 of existing fluid conduit 8, and use an adaptor 1 so that the external dimensions of arms 3, 4 fit the internal bore diameters 5, 7 of conduits 6, 8.

Figure 2:
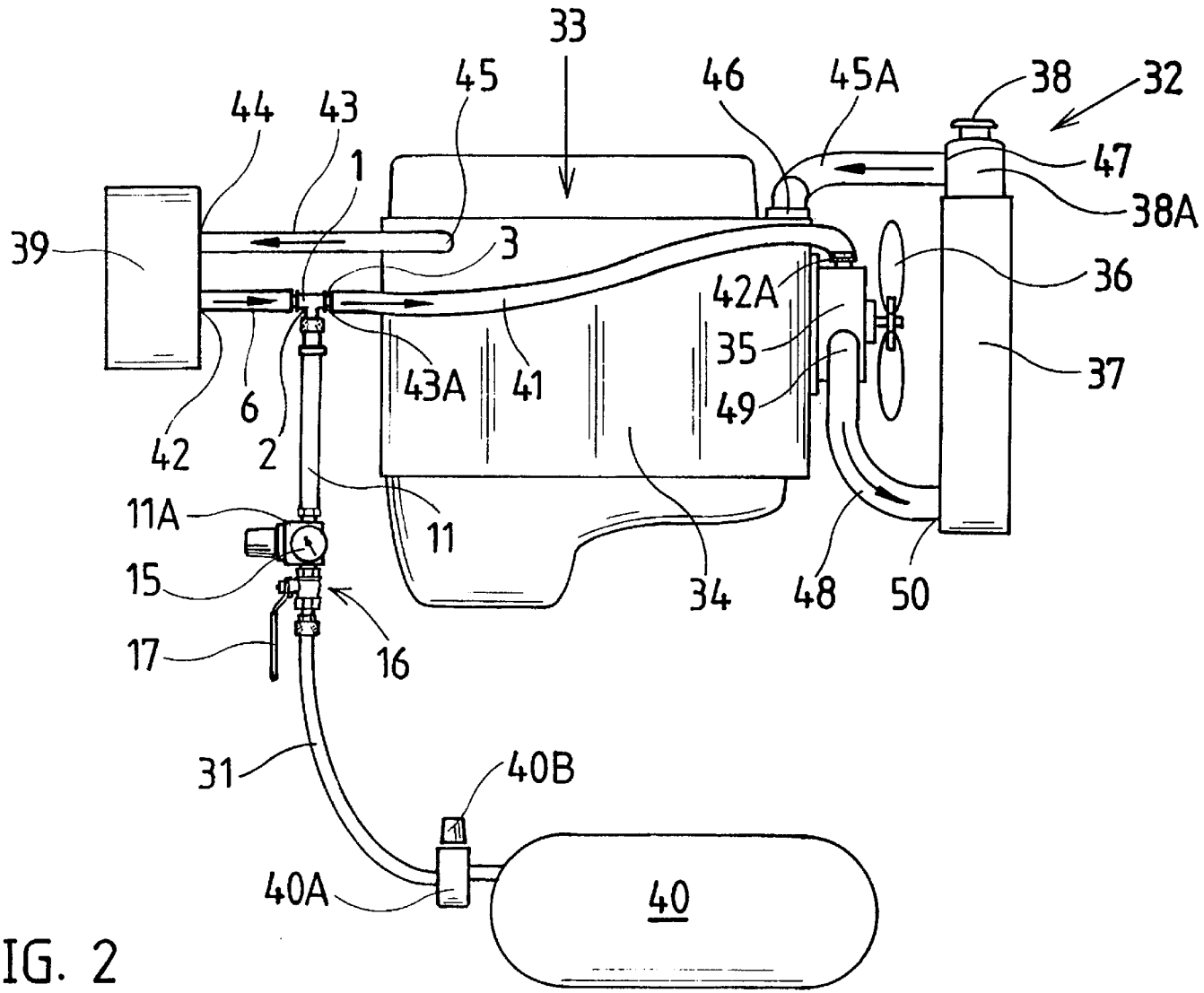
FIG. 2 is a view of an internal combustion engine cooling system incorporating the pressure testing apparatus of FIG. 1.

FIG. 2 shows one such application, in this case a cooling system 32 of a motor vehicle engine 33. The cooling system 32 comprises engine block 34, water pump 35 with attached cooling fan 36, radiator 37 with cap 38, filler neck 38A and heater 39 with connecting hoses 41, 43, 45A and 48 therebetween which are connected to fluid ports 42A and 43A, 44 and 45, 46 and 47 and 49 and 50 respectively. The direction of coolant flow is indicated by the arrows. The pressure testing apparatus of the invention is installed by the operator as follows:

(a) an existing fluid conduit, in this case the outlet hose 41 of heater 39, is removed from the outlet port 42 of heater 39, and arm 3 of adaptor 1 is inserted into the internal bore of hose 41 at 43A;

(b) second air conduit 6 is then connected at one end to the outlet port 42 of heater 39, and at the other end to second arm 4 of adaptor 1;

(c) first arm 2 of adaptor 1 is then connected to first air conduit 11; and (d) by supplying pressurized air from the compressor 40 which is fitted with regulator 40A which is controlled by control knob 40B, the entire cooling system 32 can then be pressurized with the desired level of pressure set by the operator by adjusting knob 14 of pressure regulator 11A.

In operation, the pressure testing apparatus of the invention is effectively integrated into the cooling system 32 without removal of cap 38 of radiator 37 and, if desired, the operator can have the engine running to achieve normal running conditions, and allow the cooling system 32 to reach its normal operating temperature. The operator can then test for leaks as follows: the control valve 16 can stop the flow of pressurized air once a desired pressure has been reached, and any loss in pressure indicative of a leak could be detected by observing gauge 15; to locate the source of a leak, constant pressure can be maintained via the source of pressurized air, and the cooling system 32 inspected for visual or audible signs of fluid leakage. In the case of "slow" leaks, the cooling system 32 can be pressurized for hours, if necessary, with minimal manual effort by the operator. Furthermore, by retaining the pressure relief valve function of the radiator cap 38, over-pressurization can be avoided. Also, by testing for leaks at normal running temperatures, "slow" leaks resulting from small fissures or holes, cracks, gaskets, shaft seals and O-rings which often disappear due to contraction of cooling system components upon cooling, can be detected.

It should also be appreciated that the pressure testing apparatus of the invention could be connected to any of the components of a cooling system. Thus, in the embodiment of FIGS. 1–2, the pressure testing apparatus of the invention can be applied to the following situations:

(i) disconnection of conduit 43 which interconnects port 44 of heater 39 and port 45 of engine block 34;

(ii) disconnection of conduit 45A which interconnects port 46 of engine block 34 and port or outlet 47 of radiator 37; or (iii) disconnection of conduit 48 which interconnects port 49 of pump 35 and inlet port 50 of radiator 37.

In the embodiment of FIG. 3, engine 33 comprises cylinder or engine block 34, cylinder head 35 and associated spark plugs 36A, as well as tappet cover 52. There is also provided oil filler cap 53. In this embodiment, use is made of adaptor 54 shown in FIG. 3A which includes hose attachment portions 55, 56, 57 and 58, all of which have different diameters which are attachable to hoses or conduits 6 or 8 of different diameters. Each hose attachment portion 55, 56, 57 and 58 also includes retaining flanges 9. The adaptor 54 also includes end portion 2 which engages with air conduit 11. There is also shown in FIG. 3B port seal 59A.

In the embodiment of FIG. 3, adaptor 54 is attached to hose 45 which interconnects ports 46 and 47 in FIG. 2. The hose 45 is disconnected from port 47 and is then attached to adaptor 54 as shown. Port 47 is then sealed with seal 59A. Adaptor 54 is then attached to air conduit 11 for pressure testing purposes as previously described in FIG. 2. Thus, in the use of this particular embodiment, there is no necessity to use second air conduit 6.

Figure 4:
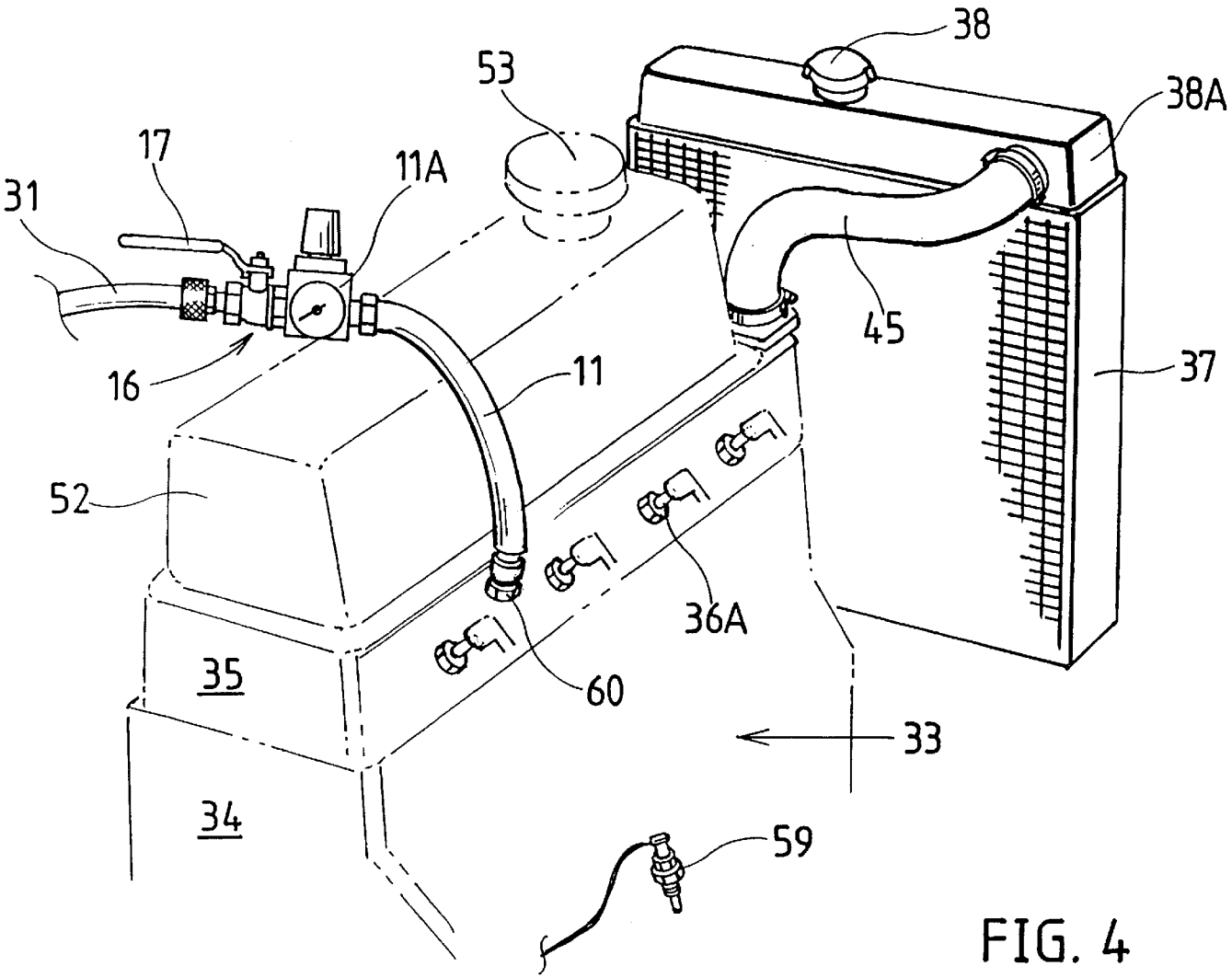
FIG. 4 is a perspective view of another embodiment of pressure testing apparatus in accordance with the invention different to that shown in FIGS. 1–2.

In a different embodiment which is shown in FIG. 4, temperature sensor 59 (which is shown in FIG. 3 attached to port 60 of cylinder head 35) is disconnected from port 60 and air conduit 11 of the pressure testing apparatus of the invention is then attached directly to port 60 for pressure testing purposes. In this embodiment, all existing hoses or conduits 41, 43, 45A and 48 are maintained in fluid communication with their respective ports.

In the embodiment of FIG. 4, it will be appreciated that this embodiment may be applied more generally to any removable component of cooling system 32 which may include, for example, not only temperature sensors but also temperature gauge sensors or other suitable removable component.

It will also be appreciated that first air conduit 11 may have attached a suitable screw-threaded coupling which corresponds to the diameter of a screw-threaded part of temperature sensor 59. Alternatively, a suitable adaptor (not shown) may be utilized in regard to interconnection of first air conduit 11 and port 60.

Figure 5:
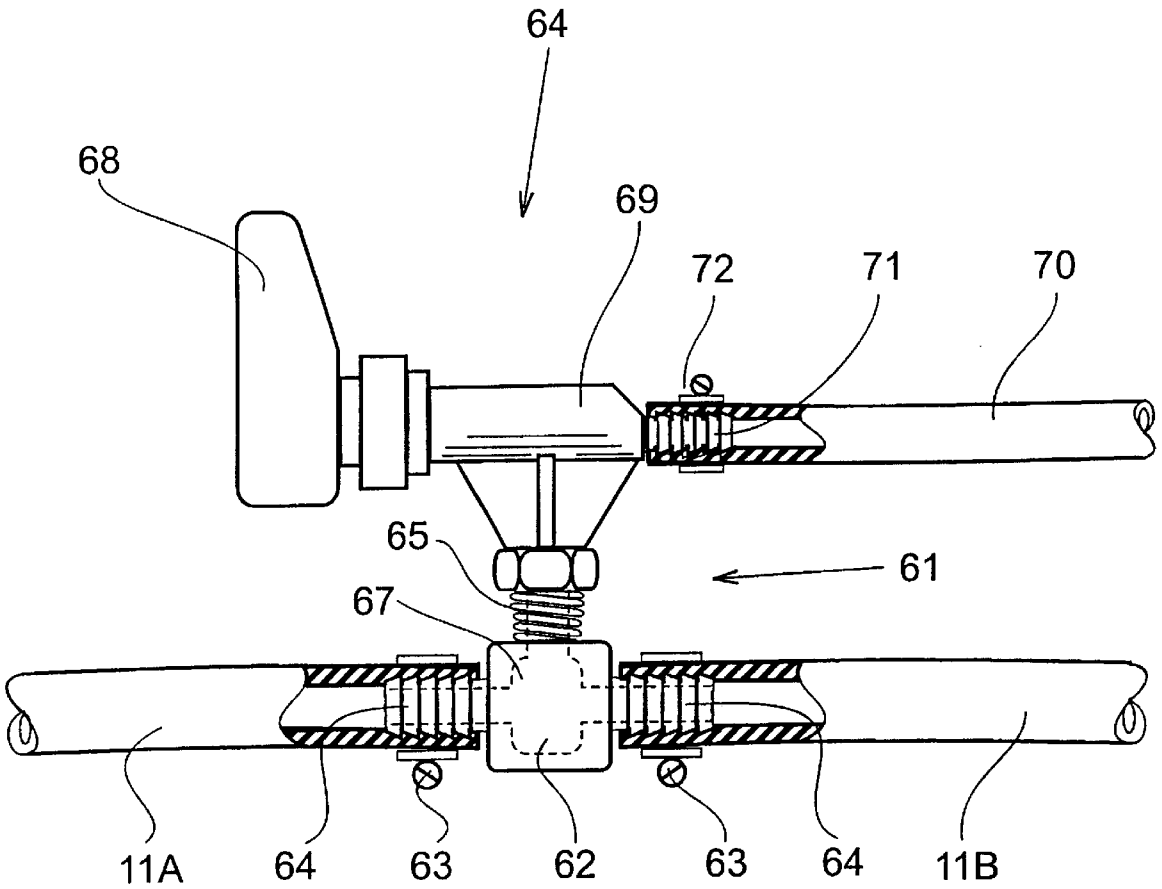
FIG. 5 is a side view of a tap assembly which may be fitted to the first air conduit.

In the valve assembly 61 shown in FIG. 5, such valve assembly is fitted as a connector between conduit components 11A and 11B which are initially severed. Conduit components 11A and 11B are part of conduit 11 shown in FIGS. 1, 2 and 4 which is connected to pressure regulator 11A which is connected to a source of pressurized air via conduit 31.

Valve assembly 61 is designed to release pressure and coolant when required whereby coolant may be discharged into a suitable container or an overflow bottle associated with the cooling system. The adoption of valve assembly 61, therefore, minimizes spillage of coolant and will alleviate pollution and facilitate operational efficiency of the cooling system. The hollow tee member 62 of valve assembly 61 is fitted into air conduit 11 in any suitable location intermediate the ends of conduit 11. The hollow tee member 62 is held in place by clamps 63 wherein arms 64 and 65 of tee member 62 are inserted in conduits 11A and 11B as shown. There is also provided a valve 64 having a spigot 65 fitted into head 67 of tee member 62 in screw-threaded engagement therewith. Tap 64 has an actuating handle 68 which is rotated relative to tap body 69 to retain pressure within conduit 11 or to release pressure from conduit 11 as may be required. Conduit 70 is attached to socket 71 of tap 64 by clamp 72. Coolant may flow through conduit 70 to the container when required.

Figure 6:
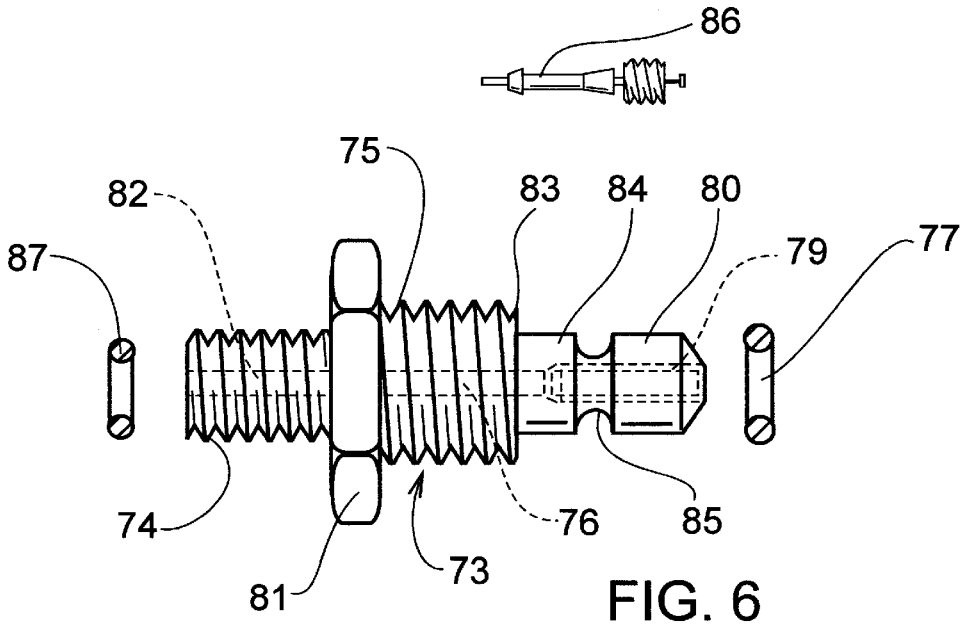
FIG. 6 is an exploded sectional view of a modified adaptor for use with the present invention.

In FIG. 6, there is shown an adaptor 73 which may replace arm 2 of T-shaped adaptor 1 shown in FIG. 1. Adaptor 73 includes threaded portions 74 and 75, O-ring 77 adapted to be mounted in groove 85, flow passages 76, 79 and 82, tapered part 80, schrader valve 86 which is adapted to be mounted in flow passage 79, and hexagonal nut 81. There is also shown shoulder 83 and mounting rib 84. The valve 86 screws into passage 79 and functions as a seal for passage 79.

Figure 7:
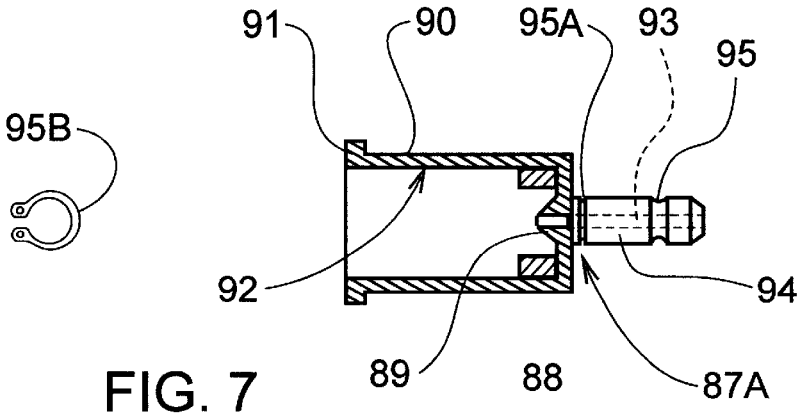
FIG. 7 is a sectional view of a sealing component which is attachable to the adaptor shown in FIG. 6.

In FIG. 7, there is shown actuator component 87A which includes sealing ring 88, valve depressor or spring 89, tapered surface 90, stop 91, internal sealing surface 92, flow passage 93 and male portion 94 having groove 95 and circlip groove 95A. There is also shown circlip 95B for rotation within groove 95A.

Figure 8:
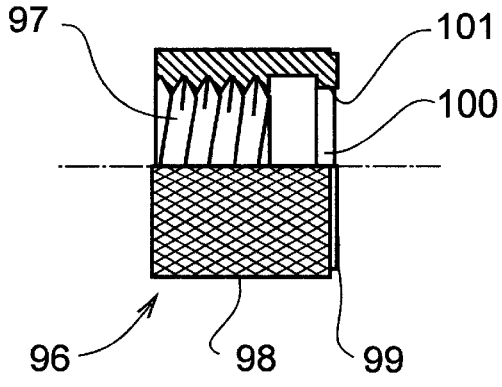
FIG. 8 is a sectional view of a cap member adapted to be fitted to the adaptor of FIG. 6.

In FIG. 8, there is shown connection component 96 having internal thread 97, knurled portion 98, adaptor nut 99, aperture 100 for male portion 94 and circlip stop face 101. In use, actuator component 87A is inserted in the hollow interior of cap member 96 and male portion 94 protrudes through aperture 100.

Figure 9:
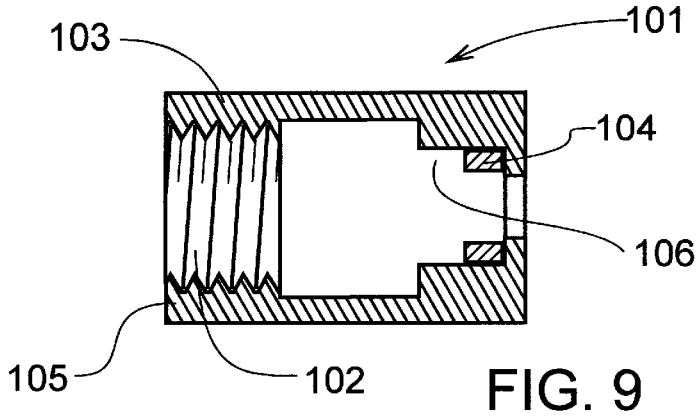
FIG. 9 is a sectional view of a sealing cap adapted to be fitted to the adaptor of FIG. 6.

In FIG. 9, there is shown a sealing cap 101 which has internal thread 102, knurled portion 103, seal 104 and stop face 105.

Figure 10:
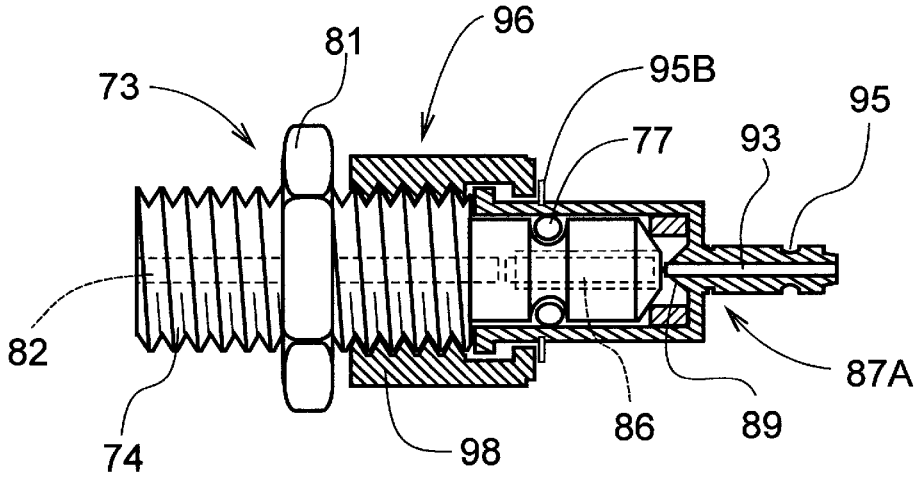
FIG. 10 is a sectional view of an adaptor assembly comprising the adaptor of FIG. 6, the actuator component of FIG. 7 and the connector component of FIG. 8.

In operation, actuator component 87A fits over O-ring 77 and flange 91 abuts shoulder 83 and is held in place by nut 99 as shown in FIG. 10. Tapered surface 90 facilitates slow compression of O-ring 77 which seals the cooling system before valve depressor 89 opens schrader valve 86. Seal 88 holds valve depressor 89 in place as well as sealing of tapered seat 80. This allows pressure to be applied through flow passage 93. Nut 99 is screwed onto thread 75 holding component 87A in place. Circlip 95B holds nut 99 in place.

Figure 11:
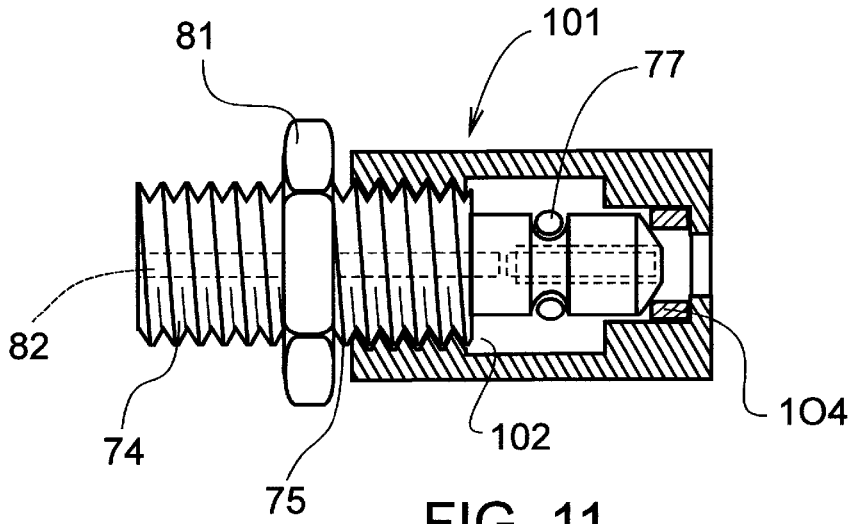
FIG. 11 is an assembly of the adaptor of FIG. 6 and the sealing cap of FIG. 9.

The sealing cap 101 screws onto thread 75 of adaptor 73 as shown in FIG. 11. Seal 104 seals onto tapered seat 80 to provide a permanent seal when the adaptor assembly is not in use. Sealing cap 101 does not contact valve 86. Recess 106 is provided to allow insertion of tapered part 80 as shown in FIG. 11.

The adaptor 73 is designed to be incorporated in the cooling system of an engine as a permanent fixture. It can be fitted into any position that provides direct access to the cooling system in such a way as to apply pressure directly to the coolant or any air gap in the coolant. This will allow pressure testing of the cooling system without removal of any of the components or parts of the cooling system except the sealing cap 101.

The adaptor 73 has a male thread 74 which can be changed to suit the specific mounting location, e.g. cylinder head, cylinder block, radiator, radiator header tank, inlet manifold, thermostat housing or any other part of the cooling system or relevant plumbing or conduits that may be applicable. For example, the adaptor assembly can be attached to port 60 of cylinder head 35 shown in FIG. 3.

As also discussed above, the adaptor assembly can be fitted to adaptor 1 shown in FIG. 1 as a substitute or replacement for arm 2. This enables the resulting adaptor assembly to become a permanent feature in the cooling system. The assembly, inclusive of adaptor 1 and adaptor 73, can then be fitted at the time of vehicle manufacture or at a later date should regular testing be required.

It will also be appreciated that the modified adaptor 73 shown in FIG. 6 may alternatively comprise any suitable valve which incorporates a valve member in a valve body having a valve chamber. Thus, the valve member may be a check valve or any other type of non-return valve. Typically such non-return valves comprise a valve member such as a ball retained in place against a valve seat by a spring as is well known in the art. However, a diaphragm could also be utilized if required.

It will also be appreciated that the actuator component 87A may also be any component which, when fitted or attached to the adaptor, is responsible for opening the valve by moving or causing to move the valve member from a closed or open position. In this regard, the actuator component includes an actuator member which contacts the valve member such as valve depressor 89 which may be a spring, abutment or projection as the case may be.

The connector component 96 may be responsible for connecting the adaptor and the actuator component to each other in sealing relationship as discussed above and when connected to the adaptor may be responsible for causing movement of the valve member from the closed to the open position as described above. However, it will also be appreciated that both the actuator component 87A and connector component 96 may be replaced by a single component which carries out both these functions.

The function of the sealing cap 101 is to retain the cooling system under pressure and prevent any dirt or other contaminants from gaining access to the cooling system in use. The sealing cap 101 may also prevent escape of coolant from the cooling system.

As described above, it will also be appreciated that the adaptor 73 is permanently incorporated in the cooling system and that actuator component 87A and connector component 96 are only attached to adaptor 73 as described above for pressure testing purposes. Sealing cap 101 is attached to adaptor 73 in normal operation of the cooling system.

Reference is now made to another embodiment of the invention as shown in FIGS. 12–17 wherein the pressure testing apparatus of the invention is accommodated with a casing so as to make its use more convenient and efficient. In such embodiment, there is shown first air conduit 11 which is connected to female connector 9A referred to in FIG. 1. Such connection has been omitted from the FIG. 12–17 embodiment for convenience. Conduit 11 extends through casing 102 by the use of coupling 103 wherein the conduit may be inserted through a central bore (not shown) of hollow coupling 103 and locked in position by locking tabs 104. Nuts 105 attach coupling 103 to side wall 106 of casing 102 by being attached to screw-threaded part 107. Conduit 11 extends through T fitting 108 and is attached thereto by hollow couplings 109 wherein conduit 11 extends through each hollow coupling 109 and is locked in position by locking tabs 110. There is also shown nuts 111 of T fitting 108 attached to screw-threaded part 112. T fitting 108 is connected to electronic transducer 113 which is connected to electronic LCD or LED display panel 114 by wiring loom or harness 115. Panel 114 indicates the pressure in conduit 11 in a digital fashion. Conduit 11 is also connected to three-way valve 116 having an actuating handle 117 by hollow coupling 109 so that fluid may extend through valve 116 in any one of the directions shown in FIGS. 14–17. This is shown in window 116A.

Figure 13:
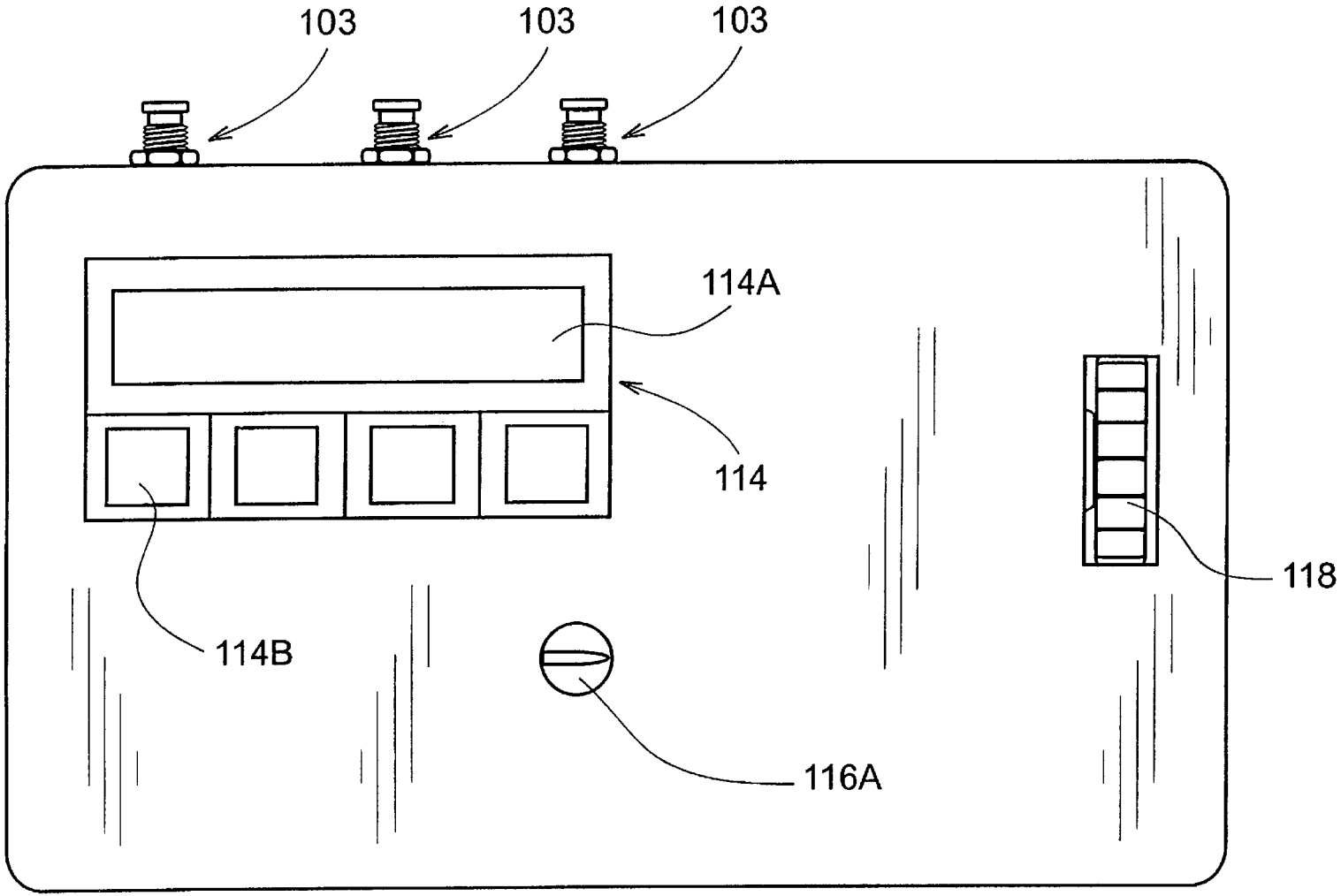
FIG. 13 is a top plan view of the casing shown in FIG. 12.
Figure 15:
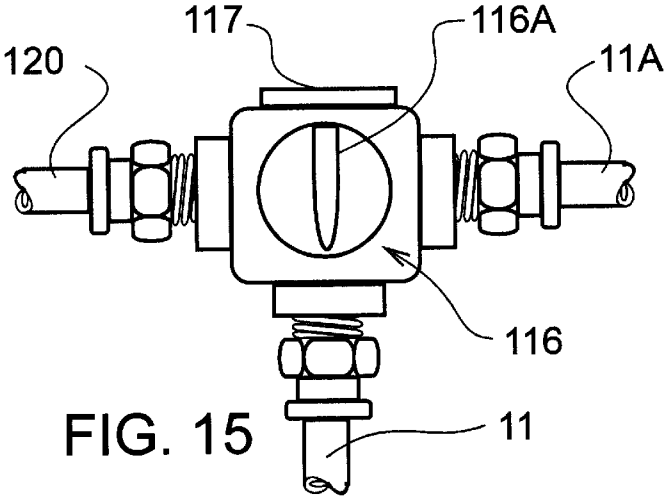
FIGS. 14–17 show various positions of the actuating handle of a three-way valve which are visible through the cover of the casing.
Figure 17:
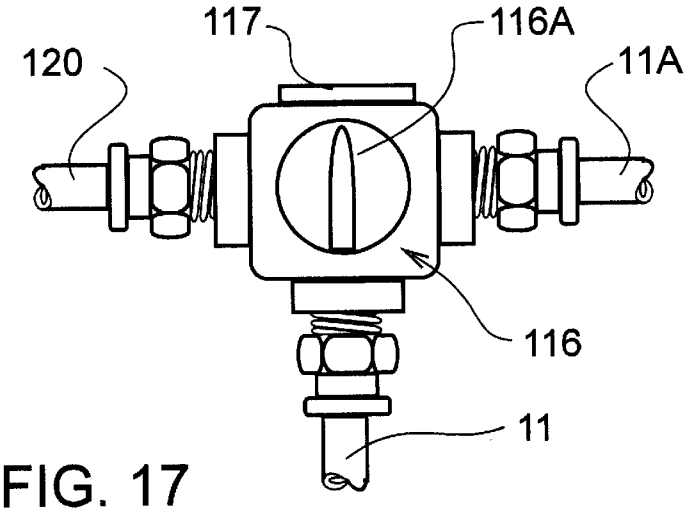

In FIG. 13, there is shown display panel 114 having display face 114A and adjustment buttons or knobs 114B.

There is also shown regulator 117A having actuating handle 118 to regulate the amount of pressure required in conduit 11A which is connected to three-way valve 116 by hollow coupling 109. There is also shown one-way valve 119 which interconnects conduits 11B and 11C as shown. Coupling 103, which is attached to conduit 11C, is connected to a conduit (not shown) which communicates with an air compressor (not shown). There is also provided an exhaust conduit 120 which provides for exhausting of coolant from the cooling system being tested by the pressure testing apparatus of the invention shown in FIGS. 12–13.

Figure 12:
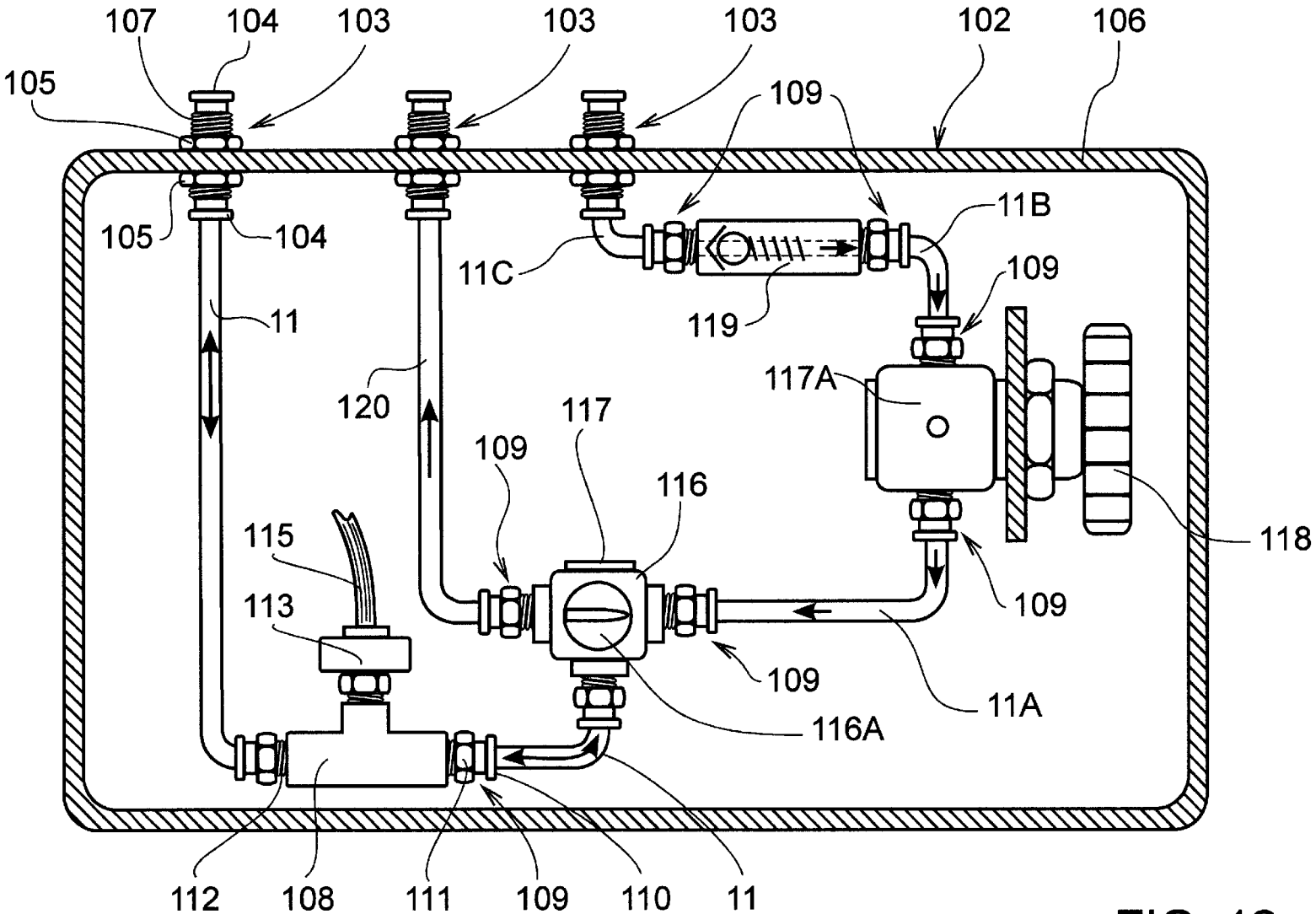
FIG. 12 is a view of an alternative form of pressure testing apparatus of the invention retained within a casing and showing a cover of the casing removed for the sake of convenience.
Figure 14:
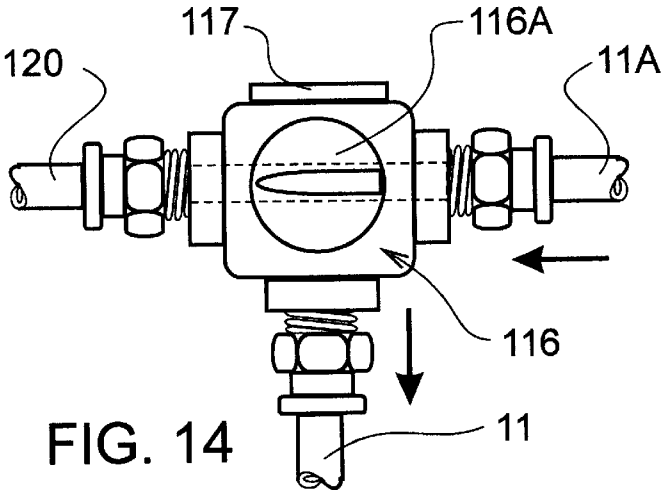
Figure 16:
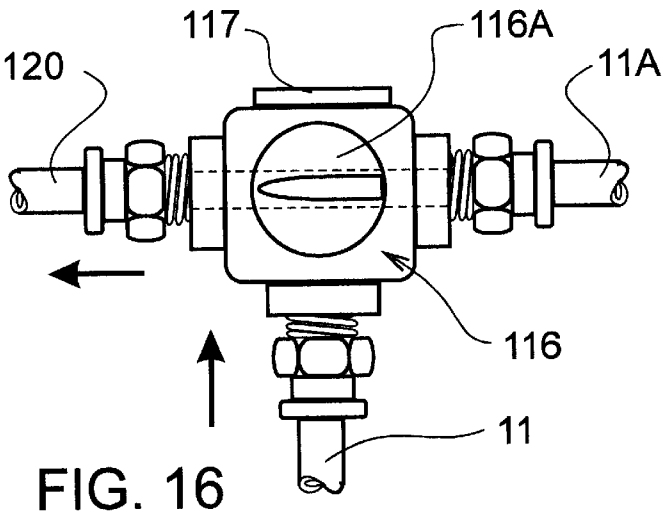

In operation, air from the compressor travels through conduits 11C and 11B as shown in FIG. 12 and is controlled at the required pressure by regulator 117A. Air then travels through conduit 11A and may pass into conduit 11 by the action of valve 113 as shown in FIG. 14. This is the required direction for testing purposes. After testing has been carried out, the valve 113 may be rotated by handle 117 to the position shown in FIG. 16 wherein liquid coolant entrained with air may be passed into exhaust conduit 120 for discharge into a receptacle. Rotation of handle 117 to the position shown in FIG. 15 holds the pressure within the cooling system being tested at a constant value. The location of the handle in either of the positions shown in FIGS. 15 or 17 holds the pressure for self-testing of the apparatus when required.

The pressure testing apparatus of the invention can be left operational with the engine running for extended periods, e.g. 12–48 hours. The normal radiator cap with its inbuilt pressure relief valve prevents over pressurization of the cooling system. The pressure testing apparatus of the invention may also be utilized for detection of leaks at all joints, connections or fittings of cooling systems which may include heater covers, radiators, radiator caps, hose fittings, head gaskets, thermostat housings, engine blocks, cylinder heads, coolant passages, sensor or adaptor threads and water pumps.

It will also be appreciated that the pressure testing apparatus of the invention can be applied to fluid cooling systems of cars, trucks, commercial light trucks, campervans, buses, tractors, cranes, harvesting farm vehicles, motor bikes, lawn mowers, stationary engines, generators, compressors, military vehicles, aircraft, tow vehicles, planes, earth moving engines, concrete agitators, airport maintenance vehicles, marine boat engines, generators, and engines utilized in stationary or mobile irrigation.

The invention also includes within its scope pressure testing apparatus for internal combustion engines which includes a plurality of adapters having at least two sockets or mounting projections of substantially the same transverse dimension.

Alternatively, the invention may also include within its scope, an adaptor having a plurality of sockets or projections which have different sizes as shown, for example, in FIG. 3A as well as one or more suitably a number of conduits corresponding to the number of sockets and projections as well as the port seal, if required.

Preferably, the aforementioned sockets or mounting projections and the corresponding conduits may vary within a broad range as set by manufacturer's specification of cooling systems, and may comprise internal diameters of 8 mm, 10 mm, 12.5–13.0 mm, 16 mm, 19 mm or 25 mm. These metric values correspond to 5/16, 3/8, 1/2, 3/4 and 1 inch.

In another aspect of the invention, there is provided an internal combustion engine cooling system pressure testing apparatus connectable to a source of pressurized air, said pressure testing apparatus comprising:

an air conduit;

means for regulating air pressure associated with the first air conduit to maintain air pressure at a predetermined value;

an exhaust conduit in fluid communication with the first air conduit for exhausting of coolant from the cooling system after use and selectively actuatable valve means controlling the flow of coolant from the first air conduit into the exhaust conduit whereby, in use, pressurized air can be supplied to the cooling system via the first air conduit to facilitate the detection of any fluid leaks present.

In this specific aspect of the invention, the provision of the exhaust conduit and the selectively actuatable valve means provides advantages over conventional pressure testing apparatus which employed pressure release valves or mechanisms which could apparently release excess fluid in the cooling system and pressure testing apparatus to atmosphere. However, in use, such pressure release was undesirable in that it resulted in a spray of toxic coolant to the atmosphere and thus, in use, was an environmental hazard. Also, release of the coolant which was usually extremely hot could result in injury to the user and for this reason may infringe existing health and safety regulations as well as providing a possible liability to persons marketing or owning such pressure testing apparatus.

What is claimed is:

1. An internal combustion engine cooling system pressure testing apparatus connectable to a source of pressurized air, said pressure testing apparatus comprising:

a first air conduit;

means for regulating air pressure associated with the first air conduit to maintain air pressure at a predetermined value;

means for switching off the flow of pressurized air from the source; and, an exhaust conduit in fluid communication with the first air conduit for exhausting of coolant from the cooling system after use and selectively actuatable valve means controlling flow of coolant from the first air conduit into the exhaust conduit, wherein the selectively actuatable valve means is a three-way valve facilitating flow of pressurized air into the first air conduit or flow of coolant into the exhaust conduit or maintaining the pressure of the pressurized air in the cooling system at a constant value and thereby functioning as said switching means.

2. A pressure testing apparatus as claimed in claim 1 wherein there is provided a transducer connected via a wiring loom or harness to a visual display for indication of the pressure of the pressurized air.

3. A pressure testing apparatus as claimed in claim 1 wherein the regulating means is located upstream of the switching means having regard to the direction of flow of pressurized air in the first air conduit.

4. A pressure testing apparatus as claimed in claim 1 wherein the first air conduit is a flexible hose.

5. A pressure testing apparatus as claimed in claim 1, said apparatus being retained within a casing having on an external surface thereof a pressure indicator, a window indicating a position of an adjustment means of the selectively actuatable valve means and an actuating handle for the regulating means which is accessible through a wall of the casing.

6. An internal combustion engine cooling system pressure testing apparatus connectable to a source of pressurized air, said pressure testing apparatus comprising:

a first air conduit;

means for regulating air pressure associated with the first air conduit to maintain air pressure at a predetermined value;

means for switching off the flow of pressurized air from the source; and, an exhaust conduit in fluid communication with the first air conduit for exhausting of coolant from the cooling system after use and selectively actuatable valve means controlling flow of coolant from the first air conduit into the exhaust conduit, wherein the selectively actuatable valve means is a three-way valve facilitating flow of pressurized air into the first air conduit or flow of coolant into the exhaust conduit or maintaining the pressure of the pressurized air in the cooling system at a constant value and thereby functioning as said switching means, wherein said pressure testing apparatus is retained within a casing having on an external surface thereof a pressure indicator, a window indicating a position of an adjustment means of the selectively actuatable valve means and an actuating handle for the regulating means which is accessible through a wall of the casing.

7. A method of pressure testing a cooling system of an internal combustion engine including the steps of:

(i) placing the cooling system in fluid communication with a source of pressurized air;

(ii) passing pressurized air into the cooling system;

(iii) adjusting the pressure developed within the cooling system to a predetermined value which may accord with manufacturers' specifications which is usually less than a maximum pressure rating of the cooling system;

(iv) switching off the source of pressurized air; and (v) checking for pressure leaks within said cooling system; and (vi) exhausting coolant from the cooling system by directing flow of coolant into a receptacle from an exhaust conduit.

* * * * *